US009021721B2

(12) United States Patent
McCarron

(10) Patent No.: US 9,021,721 B2
(45) Date of Patent: May 5, 2015

(54) FOOTWEAR

(75) Inventor: Michael P. McCarron, Danville, CA (US)

(73) Assignee: Ariat International, Inc., Union City, CA (US)

( * ) Notice: Subject to any disclaimer, the term of this patent is extended or adjusted under 35 U.S.C. 154(b) by 811 days.

(21) Appl. No.: 13/099,139

(22) Filed: May 2, 2011

(65) Prior Publication Data

US 2011/0271553 A1 Nov. 10, 2011

Related U.S. Application Data

(60) Provisional application No. 61/332,538, filed on May 7, 2010.

(51) Int. Cl.

| | |
|---|---|
| ***A43B 13/00*** | (2006.01) |
| ***A43B 5/00*** | (2006.01) |
| ***A43B 5/14*** | (2006.01) |
| ***A43B 13/18*** | (2006.01) |
| ***A43B 21/26*** | (2006.01) |

(52) U.S. Cl.

CPC ..... *A43B 5/006* (2013.01); *A43B 5/145* (2013.01); *A43B 13/187* (2013.01); *A43B 21/26* (2013.01)

(58) Field of Classification Search

CPC ..... A43B 13/00; A43B 13/12; A43B 13/122; A43B 13/125; A43B 13/127; A43B 13/18; A43B 13/42; A43B 21/26; A43B 23/222

USPC ..... 36/28, 30 R, 37

See application file for complete search history.

(56) References Cited

U.S. PATENT DOCUMENTS

| | | | |
|---|---|---|---|
| 3,705,463 | A | 12/1972 | Lown |
| 3,821,827 | A | 7/1974 | Nadler |
| 4,316,335 | A | 2/1982 | Giese et al. |
| 4,438,573 | A | 3/1984 | McBarron |

(Continued)

FOREIGN PATENT DOCUMENTS

| | | | |
|---|---|---|---|
| CN | 1419424 | A | 5/2003 |
| CN | 1947610 | A | 4/2007 |

(Continued)

OTHER PUBLICATIONS

International Search Report and Written Opinion mailed Aug. 5, 2011 in Int'l Patent Application No. PCT/US2011/034896, 8 pages.

(Continued)

*Primary Examiner* — Marie Bays

(74) *Attorney, Agent, or Firm* — DASCENZO Intellectual Property Law, P.C.

(57) ABSTRACT

Footwear according to the present disclosure includes an upper and a sole assembly coupled to the upper, with the sole assembly including an outsole with a ground-contacting surface and a midsole positioned above the outsole. The midsole includes a peripheral lasting member that defines a central aperture, and a cushioning member positioned at least above the peripheral lasting member. In some embodiments, the footwear further includes a heel and the midsole includes a heel strike projection that engages the heel. In some embodiments, the midsole further includes a shank. In some embodiments, the cushioning member defines the optional heel strike projection, and in other embodiments, the optional shank defines the optional heel strike projection. In some embodiments, the footwear includes a spur support.

45 Claims, 5 Drawing Sheets

(56) References Cited

U.S. PATENT DOCUMENTS

| | | | | |
|---|---|---|---|---|
| 4,908,962 | A * | 3/1990 | Yung-Mao | 36/28 |
| 5,426,870 | A * | 6/1995 | Purnell et al. | 36/84 |
| 5,435,078 | A * | 7/1995 | Pyle | 36/30 R |
| 5,768,801 | A * | 6/1998 | Huff | 36/17 R |
| 5,911,491 | A * | 6/1999 | Huff | 36/17 R |
| 5,979,079 | A | 11/1999 | Krajcir | |
| 6,145,220 | A * | 11/2000 | Johnson et al. | 36/34 R |
| 6,367,172 | B2 | 4/2002 | Hernandez | |
| 6,497,057 | B1 | 12/2002 | Lee et al. | |
| 6,505,420 | B1 | 1/2003 | Litchfield et al. | |
| 6,802,138 | B2 | 10/2004 | McManus et al. | |
| 6,842,999 | B2 | 1/2005 | Russell | |
| 6,948,263 | B2 * | 9/2005 | Covatch | 36/30 R |
| 7,036,245 | B2 | 5/2006 | Russell | |
| 7,168,186 | B2 | 1/2007 | Russell | |
| 7,200,955 | B2 | 4/2007 | Foxen | |
| 7,310,928 | B2 | 12/2007 | Curry | |
| 7,752,773 | B2 | 7/2010 | McCarron | |
| 7,913,427 | B2 * | 3/2011 | Edwards et al. | 36/131 |
| 8,191,284 | B2 * | 6/2012 | Cho | 36/3 B |
| 2003/0101619 | A1 | 6/2003 | Litchfield et al. | |
| 2003/0150131 | A1 * | 8/2003 | McManus et al. | 36/28 |
| 2004/0181970 | A1 | 9/2004 | Covatch | |
| 2005/0091881 | A1 * | 5/2005 | Burgess | 36/30 R |
| 2005/0223604 | A1 | 10/2005 | Neuner | |
| 2007/0011918 | A1 * | 1/2007 | Snow et al. | 36/108 |
| 2008/0110057 | A1 | 5/2008 | Eades et al. | |
| 2009/0056172 | A1 * | 3/2009 | Cho | 36/3 B |
| 2009/0083997 | A1 | 4/2009 | Edwards et al. | |
| 2010/0126044 | A1 | 5/2010 | Davis | |

FOREIGN PATENT DOCUMENTS

| | | | |
|---|---|---|---|
| CN | 101472493 | A | 7/2009 |
| WO | 2005/117628 | A2 | 12/2005 |

OTHER PUBLICATIONS

International Preliminary Report on Patentability mailed Jun. 17, 2012 in Int'l Patent Application No. PCT/US2011/034896, 31 pages.

Patent Examination Report mailed Jul. 29, 2013 in Australian Patent Application No. 2011248386, 3 pages.

Office Action mailed Dec. 20, 2013 in Canadian Patent Application No. 2,798,475, 2 pages.

Patent Examination Report mailed Sep. 1, 2014 in Australian Patent Application No. 2011248386, 4 pages.

* cited by examiner

FOOTWEAR

RELATED APPLICATION

The present application claims priority under 35 U.S.C. §119(e) to U.S. Provisional Patent Application Ser. No. 61/332,538, entitled "FOOTWEAR AND FOOTWEAR SOLES WITH SHANK-STIFFENED MIDSOLES," which was filed on May 7, 2010, and the disclosure of which is incorporated herein by reference.

FIELD OF THE DISCLOSURE

The present disclosure is directed to footwear.

BACKGROUND OF THE DISCLOSURE

Heeled footwear, such as boots, are worn for a variety of applications, including as dress shoes, work boots, hiking boots, and riding boots. Historically, heeled footwear have not provided the same support and stability as other forms of footwear, such as athletic shoes, and tend to be heavier than many other types of footwear, including athletic shoes. Conventionally, such heeled footwear includes a rigid shank that extends from a forefoot region of the sole to a heel region of the sole to provide structural support to the footwear. This shank typically is secured to an outsole portion of the footwear, above which a midsole and/or footbed are positioned. The sole of the footwear is often formed from layers of leather or a similar material, and the heel and sole of such footwear may provide only limited padding or shock absorption to a user's foot.

Wearers of equestrian riding boots often utilize spurs, which are tools typically coupled to a rider's boots for engaging a horse and directing the horse by the rider. Spurs typically have a yoke that wraps partially around a rear portion of a boot and that is attached to the boot by one or more straps.

SUMMARY OF THE DISCLOSURE

Footwear according to the present disclosure includes an upper and a sole assembly coupled to the upper, with the sole assembly including an outsole with a ground-contacting surface and a midsole positioned above the outsole. In some footwear according to the present disclosure, the midsole includes a peripheral lasting member that defines a central aperture, and a cushioning member positioned at least above the peripheral lasting member. In some embodiments, the footwear further includes a heel, and the midsole includes a heel strike projection that engages the heel. In some embodiments, the midsole further includes a shank. In some embodiments, the cushioning member defines the optional heel strike projection, while in other embodiments, the optional shank defines the heel strike projection. In some embodiments, the optional heel includes an inner resilient, shock-absorbing pad, which is engaged by the optional heel strike projection of the midsole.

Footwear according to the present disclosure may include one or more spur support members positioned and configured to receive and retain a spur in a selected position. In some embodiments, a spur support member is positioned and configured to retain a spur in at least two distinct positions. In some embodiments, the spur support member is coupled to a flexible base that selectively extends behind the footwear.

DETAILED DESCRIPTION AND BEST MODE OF THE DISCLOSURE

Figure 1:
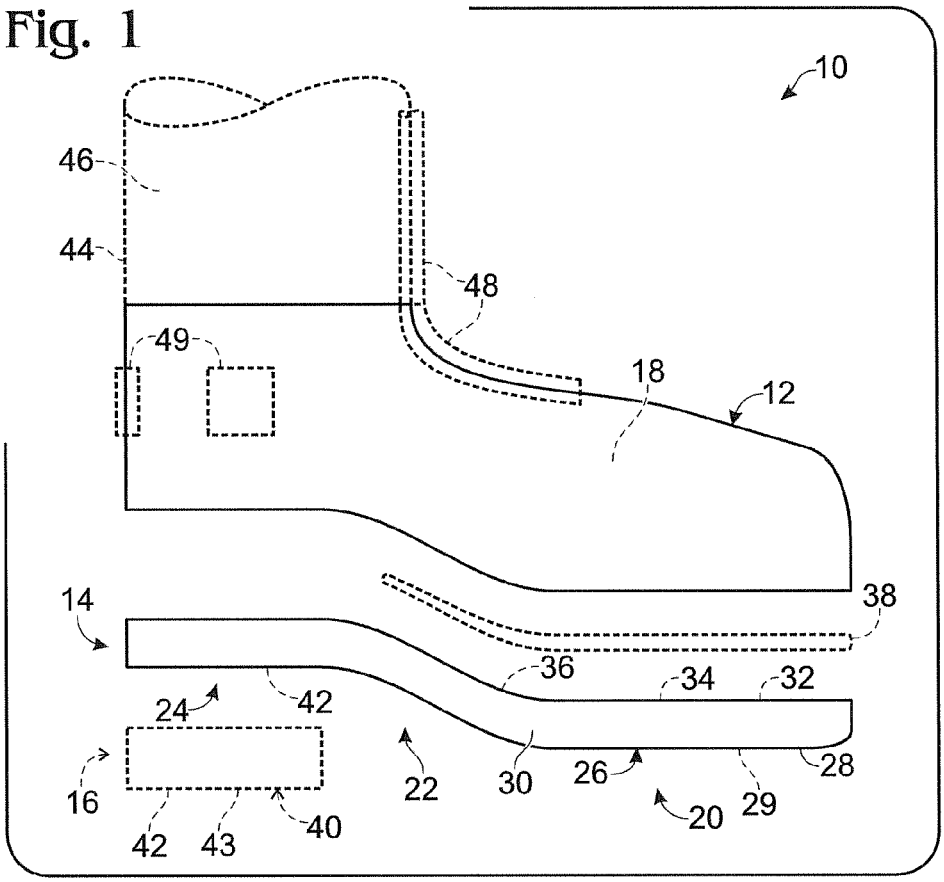
FIG. 1 is an exploded schematic side view diagram of footwear and footwear sole assemblies according to the present disclosure.

Articles of footwear according to the present disclosure are schematically illustrated in FIG. 1 and generally indicated at 10. As illustrated in FIG. 1, footwear 10 according to the present disclosure include an upper 12, a sole 14 coupled to the upper, and in some embodiments, a heel 16 coupled to the sole. The sole and upper collectively define a foot compartment, or chamber, 18 that is sized to receive a wearer's foot. Soles 14 according to the present disclosure additionally or alternatively may be referred to as sole assemblies 14, and uppers 12 according to the present disclosure may additionally or alternatively be referred to as footwear uppers 12.

While the examples illustrated and discussed herein generally relate to heeled footwear with heels 16, the present disclosure is not limited to heeled footwear, and the various components and characteristics of footwear 10 disclosed herein, including the discussed sole assemblies 14, also may be used with footwear not having a distinct heel structure that is separate and apart from the sole of the footwear. Moreover, as discussed in detail herein, some footwear according to the present disclosure relates to inclusion of a spur support member; however, footwear according to the present disclosure that includes such a spur support member are not required to have the structure of the sole assemblies discussed herein, and vice versa.

As discussed in more detail herein, components of footwear 10, such as components of a sole assembly 14, may be described in terms of relative positions with respect to the article of footwear. For example, as schematically indicated in FIG. 1, a sole assembly 14 and its component parts may be described in relation to a forefoot region 20, an arch (or midfoot) region 22, and a heel region 24, with the arch (or midfoot) region extending between the forefoot and heel regions, and with these regions positioned generally underneath the corresponding forefoot, arch (or midfoot), and heel regions of a wearer's foot when an article of footwear 10 is being worn by a wearer, who additionally or alternatively may be described as a user of footwear 10.

As used herein, the terms "upper," "above," "top," "lower," "below," "bottom," and similar terms as used to describe spatial relationships between components of footwear 10, and/or between a component of footwear 10 and a ground surface or other object, are considered from the perspective of footwear 10 positioned in an upright orientation on a level ground surface. Accordingly, an upper surface, or upper side, refers to a surface or side of a component that generally faces away from the ground surface, and a lower surface, or lower side, refers to a surface or side that generally faces toward the ground surface.

As schematically illustrated in FIG. 1, sole assembly 14 includes an outsole 26, which additionally or alternatively may be referred to as an outer sole 26, and which may include an optional tread region 29 in at least a forefoot region thereof. As used herein, a tread region is a region of a ground-contacting surface of an article of footwear that includes distinct tread structure, such as including a non-smooth surface, and in some embodiments including tread projections, tread channels or cavities, and the like. However, it is also within the scope of the present disclosure that portions, and in some embodiments all, of the ground-contacting surface of an article of footwear 10 may be substantially smooth, such as is typical with men's dress shoes, cowboy boots, and the like that conventionally include leather outsoles, for example. Other configurations are also within the scope of the present disclosure, and regardless of the presence of a tread region, the outsole may be described as having an outsole forefoot region that includes at least forefoot ground-contacting surface 28, and in embodiments without a distinct heel, a heel ground-contacting surface. Illustrative, non-exclusive examples of suitable materials for construction of a ground-contacting surface, including a tread region, of footwear 10 according to the present disclosure include (but are not limited to) one or more of polymers, elastomers, polyurethanes, leathers, synthetic rubbers, and such injection-moldable polymers as thermo polyurethanes, thermo poly rubbers, and thermo rubbers.

Sole assembly 14 further includes a midsole, or midsole assembly, 30 positioned above outsole 26, and additionally may (but is not required to) include at least one of a liner 32, an insole 34, and/or a footbed 36 positioned above the midsole.

Upper 12 is attached to the sole of the footwear via a suitable lasting process, and in some embodiments may include a welt 38. Although FIG. 1 schematically illustrates that footwear 10 may include welt 38, it is within the scope of the present disclosure that some footwear 10 according to the present disclosure may not include a welt.

Similar to the outsole forefoot region, a lower surface 40 of heel 16, when present, may be described as including a heel ground-contacting surface 42. As mentioned, in embodiments that do not include a separate heel, the outsole may be described as including a heel ground-contacting surface 42. When footwear 10 includes a heel, as schematically illustrated in FIG. 1 in dashed lines, the heel generally extends from and below the outsole heel region. Accordingly, in embodiments of footwear 10 that include a heel 16, at least a portion, if not all, of the outsole arch region will be spaced away from and above, and typically will not contact, a ground surface when the footwear is worn and used for walking along a level ground surface. Ground-contacting surface 42 may (but is not required to) include a tread region 43.

Although not required to all footwear 10 according to the present disclosure, upper 12 may include a shaft, or chimney, 44 that extends from foot chamber 18 and defines a passage 46 that is configured to extend along at least a portion of a user's leg to form a boot. As such, passage 46 may be referred to as a leg passage. When upper 12 includes a shaft 44 and thus is a boot, the length of the shaft may vary, such as to form a low boot, in which case the shaft may extend past the Achilles region of the user's leg and terminate proximate, or slightly above, a user's ankle, a medium-length boot, in which case the shaft may terminate proximate a user's mid-calf, or a high boot, in which case the shaft may terminate near a user's knee, such as within a few inches of a user's knee. When upper 12 does not include a shaft that extends along a user's leg, then an article of footwear 10 according to the present disclosure may be referred to as a shoe. Illustrative, non-exclusive examples of footwear 10 according to the present disclosure include boots, such as riding (equestrian) boots, tall boots, mid-length boots, short boots, hiking boots, English boots, Western boots, cowboy boots, work boots, paddock boots, Wellington boots (for example, rain boots, muckboots, and the like), and motorcycle boots, and shoes, such as heeled shoes, hiking shoes, and dress shoes.

Regardless of whether or not upper 12 includes a shaft 44, upper 12 may additionally or alternatively include at least one releasable fastener, or releasable fastening mechanism 48. Illustrative, non-exclusive examples of releasable fasteners include one or more zippers, one or more buckles, and/or laces and lacing structure. When present, the one or more releasable fasteners may be used to selectively tighten or loosen the fit of the upper around at least a user's foot, such as by selectively increasing or decreasing the size of foot chamber 18. When the upper includes a shaft 44 and a releasable fastener 48, it is additionally or alternatively also within the scope of the present disclosure that a releasable fastener 48 may be positioned on and/or extend along the shaft to selectively tighten or loosen the fit of the upper around at least a portion of the user's leg. It also is within the scope of the present disclosure that the upper may not include such a releasable fastener. For example, some boots, such as cowboy boots, typically do not include releasable fasteners, whereas other boots, such as work boots, typically include releasable fasteners.

As also schematically and optionally illustrated in dashed lines in FIG. 1, footwear 10 according to the present disclosure in some embodiments may include one or more spur support members 49. Optional spur support members are discussed in more detail herein, but as schematically represented in FIG. 1, a spur support member, when present, may be positioned on a lateral side or on a rear side of upper 12 and may be described as a component of an upper 12. Other positions are also within the scope of the present disclosure including other positions on an upper, as well as positions on, and optionally as a component of, sole assembly 14 and heel 16, when present.

Figure 2:
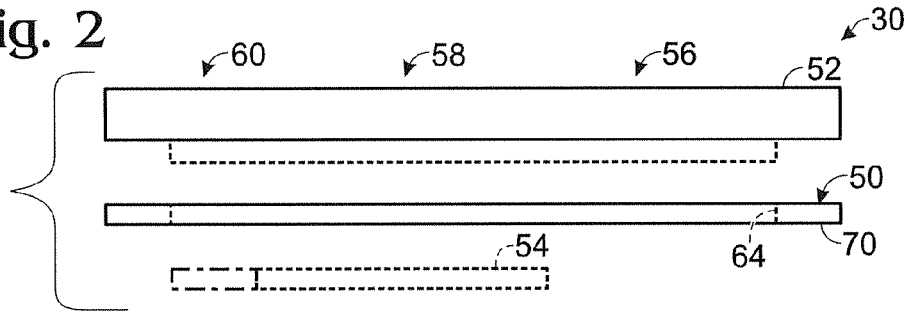
FIG. 2 is an exploded schematic side view diagram representing midsoles according to the present disclosure.
Figure 3:
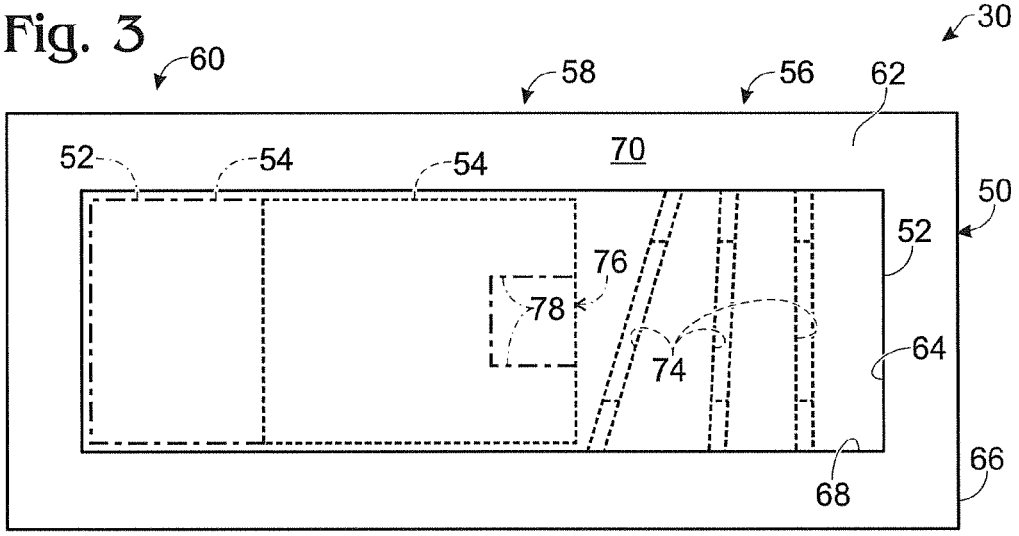
FIG. 3 is a schematic bottom view diagram representing midsoles according to the present disclosure.
Figure 4:
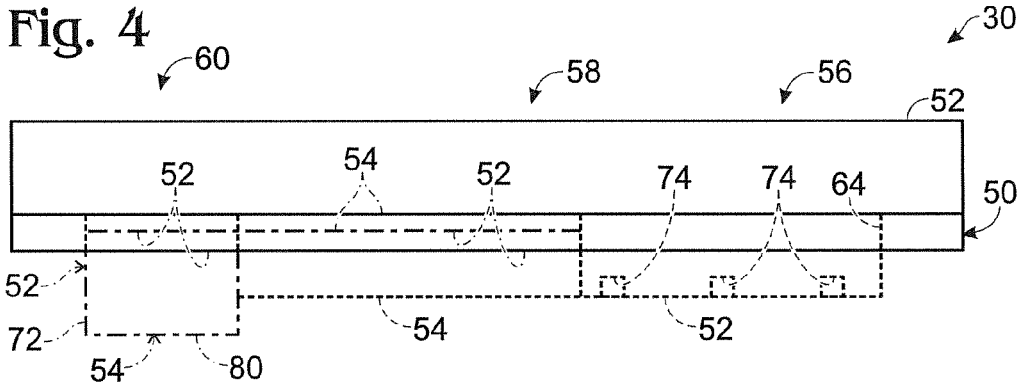
FIG. 4 is a schematic side view diagram representing midsoles according to the present disclosure.

FIGS. 2-5 schematically represent illustrative, non-exclusive examples of suitable midsoles 30 of sole assemblies 14 according to the present disclosure that may form a portion of footwear 10 according to the present disclosure. As indicated in FIGS. 2-4, a midsole 30 according to the present disclosure may include at least two distinct components, including a lasting member 50 and a cushioning member 52. In some embodiments, as represented in FIGS. 2 and 4 in dashed lines, a midsole according to the present disclosure may additionally include an optional shank, or shank member, 54.

As discussed herein and as schematically indicated in FIGS. 2-5, a midsole 30 may be described as having a midsole forefoot region 56, a midsole arch (or midfoot) region 58, and a midsole heel region 60, with these regions positioned generally underneath the corresponding regions of a wearer's foot when positioned within the foot compartment of the article of footwear, and above the corresponding regions of an article of footwear's outsole. Moreover, component parts of a midsole 30, such as the lasting member 50, the cushioning member 52, and the optional shank 54 may be described as including one or more of such forefoot, arch, and heel regions and/or as extending into the respective regions of the midsole, where appropriate.

Referring to FIG. 3, which schematically illustrates the bottom of midsoles 30, lasting member 50 defines a peripheral region 62, which additionally or alternatively may be described as a margin region or a lasting margin of the sole. Peripheral region 62 extends around, and optionally fully around, a lower side of the midsole, thereby defining a central aperture 64 that extends through the lasting member within the midsole forefoot region 56, the midsole arch region 58, and the midsole heel region 60. The lasting member may additionally or alternatively be referred to as a peripheral member, a peripheral lasting member, a lasting board, and/or a lasting portion 50. In some embodiments, the outer periphery 66 and the inner periphery 68 of the lasting member may be generally concentric, such as schematically illustrated in FIG. 3; however, this configuration is not required in all embodiments. Additionally or alternatively, the lasting member may be described as having a substantially constant width around the central aperture of the lasting member. The lasting member is described as optionally extending fully around the lower side of the midsole, because it is within the scope of the present disclosure that the lasting member may include one or more removed sections, or gaps, between adjacent sections of the lasting member, yet still extend around, and in some embodiments extend substantially around, the lower side of the midsole. Additionally or alternatively, the lasting member may be constructed in two or more sections with these sections defining the lasting member when the midsole is fully assembled.

The size, shape, and configuration of lasting member 50 may vary between embodiments without departing from the scope of the present disclosure. As illustrative, non-exclusive examples, the lasting member may define less than 75%, less than 50%, or less than 25% of the surface area of the lower side of the midsole. In other words, the ratio of the surface area of the bottom of the lasting member relative to the surface area of the lower side of the midsole as a whole may be less than 3 to 4, less than 1 to 2, or less than 1 to 4, with these ratios being illustrative and non-exclusive. Sizes of the lower side of lasting members 50 outside of the values enumerated herein are also within the scope of the present disclosure, and the present disclosure is not limited to the specific ranges discussed.

Lasting member 50 is so named because it includes a lasting surface 70 on the underside, or bottom, of the lasting member, with this lasting surface being configured to be coupled to a corresponding upper of an article of footwear 10, such as utilizing a conventional or other suitable lasting process of footwear assembly. As illustrative, non-exclusive examples, the lasting member may be one or more of stitched, tacked, or adhered to an upper, such as with a glue, an epoxy, or other adhesive. Lasting member 50 may be described as being constructed of a lasting material, such as a lasting material that is conventionally used in the footwear industry. As illustrative, non-exclusive examples, the lasting member may be constructed of natural, synthetic, composite, or other materials, including (but not limited to) leather, paperboard, fiberboard, and resin impregnated paperboard or fiberboard.

Still referring to FIGS. 2-5, midsoles 30 according to the present disclosure include a cushioning member 52 that is positioned at least above lasting member 50 and that extends across the midsole forefoot region 56, the midsole arch region 58, and the midsole heel region 60. By positioned at least above the lasting member, it is meant that at least a portion of the cushioning member extends above the lasting member, but that it is within the scope of the present disclosure that in some embodiments the entirety of the cushioning member may extend above the lasting member, that in some embodiments one or more portions of the cushioning member may extend into the central aperture 64 of the lasting member, and that in some embodiments one or more portions of the cushioning member may extend completely through the central aperture of the lasting member and thereby extend below the lasting member. The cushioning member is typically (although not required to be) coupled to the lasting member. As illustrative, non-exclusive examples, the cushioning member may be one or more of molded to, adhered to, stitched to, or tacked to the lasting member. In some embodiments, the cushioning member additionally or alternatively may be referred to as a molded resilient midsole body 52.

As mentioned, it is within the scope of the present disclosure that in some embodiments the cushioning member extends at least partially into central aperture 64 of lasting member 50. This is schematically illustrated in FIG. 2 in dashed lines, with a portion of the lower side of the cushioning member extending down from and below the margin, or peripheral, or edge, region of the cushioning member. Various optional configurations of cushioning members 52 also are illustrated schematically in FIG. 4, with a portion of the cushioning member illustrated in dashed lines extending completely and optionally through the forefoot region of central aperture 64, with a portion of the cushioning member illustrated in dash-dot lines extending only partially and optionally through the arch region of the central aperture, and with a portion of the cushioning member illustrated in dash-dot lines extending only partially, completely, and optionally through the heel region of the central aperture. Other configurations are also within the scope of the present disclosure, and it is within the scope of the schematic illustration of FIG. 4 that the cushioning member may extend partially within, extend fully within but not beyond the bottom of, and completely (or fully) through the central aperture and below the lasting surface of the lasting member in one or more of the forefoot, arch, and heel regions of the midsole, depending on the particular embodiment of a midsole 30 according to the present disclosure. Moreover, in embodiments in which more than one portion of the cushioning member extends fully through the central aperture of the lasting member, one portion may extend further below the lasting member than another portion. Additional illustrative, non-exclusive configurations include a cushioning member that does not extend fully through the central aperture within at least a substantial portion of the midsole arch region, and a cushioning member that does not extend below the lasting member within at least a substantial portion of the midsole arch region.

As discussed in more detail herein, in embodiments that include a portion of the cushioning member that extends fully through the heel region of the central aperture, this portion may be described as defining a heel strike projection 72, which, in embodiments that include a heel 16, may be configured to engage the heel, at least when a user walks or runs along a ground surface while wearing footwear 10 having a cushioning member with such a configuration. It is within the scope of the present disclosure that when a heel portion of the cushioning member extends fully through the heel region of the central aperture (for example, defining a heel strike projection), such a portion may extend a distance below the lasting member that is greater than a distance below the lasting member that another portion of the cushioning member extends below the lasting member, such as a portion extending through the forefoot region of the central aperture. Other configurations are also within the scope of the present disclosure.

Figure 5:
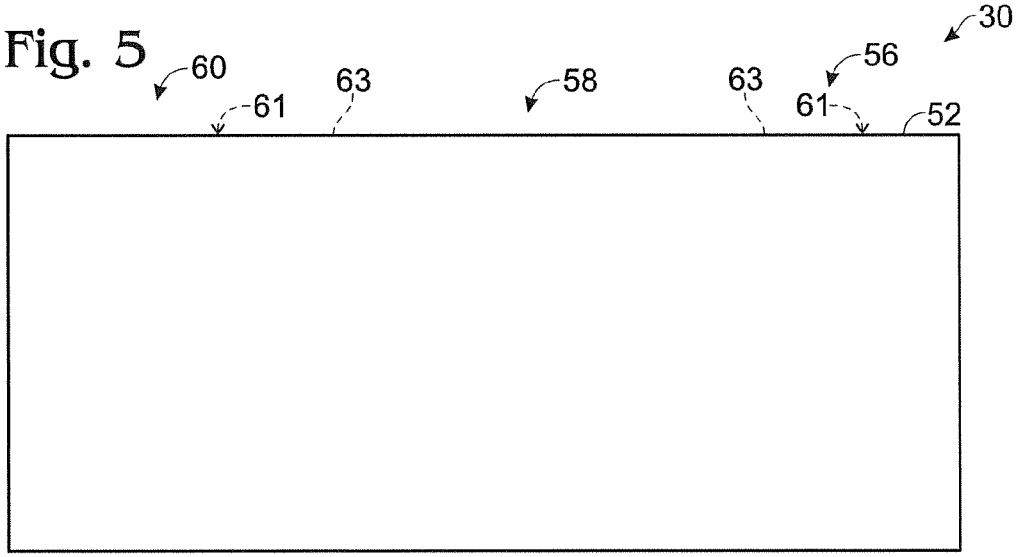
FIG. 5 is a schematic top view diagram representing midsoles according to the present disclosure.

In the schematic illustration of FIG. 5, representing the top side of a midsole 30 according to the present disclosure, the cushioning member is illustrated as defining the entirety of the top, or upper, side of the midsole. This configuration is not required in all embodiments, and in some embodiments the upper side of the cushioning member may define a contoured foot cradle 61 that generally corresponds to a shape of a wearer's foot, or at least of a typical human foot, for example, with raised edge regions that form a cup, or cradle, around at least a heel and/or forefoot portion of a wearer's foot, and optionally with a raised upper, inner arch region that is configured to extend up toward a wearer's foot arch. The contoured foot cradle may additionally or alternatively be described as having tapered lateral and/or peripheral edges 63 that extend at least partially around a lower portion of a wearer's foot when positioned within the foot compartment of an article of footwear 10.

Relative portions of the cushioning member may be positioned with respect to the lasting member in a variety of suitable configurations. For example, in some embodiments, at least a substantial portion of the cushioning member is positioned above the lasting member and the central aperture. In other embodiments, a substantial portion of the cushioning member may be positioned within the central aperture, while in other embodiments, a substantial portion of the cushioning member may be positioned below the lasting member.

The cushioning member is described as a cushioning member because typically (although not required) the cushioning member provides a resilient and compressible structure configured to at least partially conform to the shape of a wearer's foot and to absorb, or cushion, impact forces exerted to the wearer's foot when the wearer walks or runs while wearing footwear 10 according to the present disclosure. As an illustrative, non-exclusive example, a cushioning member 52 according to the present disclosure may be constructed of a polymeric material, such as including (but not limited to) one or more of ethylene-vinyl acetate (EVA), polyurethane (PV), and a thermoplasticelastomer (TPE). In some embodiments, the cushioning member may be softer and/or more resilient than the lasting member and/or the optional shank. The material of cushioning member 52 additionally or alternatively may be selected to be a lightweight and/or breathable material, which may include a foamed material. Accordingly, cushioning member 52 may additionally or alternatively be referred to as, or as including, a cushioning layer, a padding material, and/or a padding layer. Although not required to all embodiments, cushioning material 52 may be molded and/or formed by a molding process from a curable material. A cushioning material that retains its resiliency and structure despite being used in the midsole for a prolonged period of time may be desirable, as some foams and padding materials of conventional footwear may experience more rapid compression setting and/or degradation during use than other materials.

As schematically illustrated in dashed lines in FIGS. 3-4, in some embodiments of midsoles 30 according to the present disclosure, the cushioning member may define one or more channels, or grooves, 74 on an underside of the cushioning member, such as within midsole forefoot region 56. When present, channels 74 may extend generally transverse to the longitudinal axis of the midsole, so as to increase the flexibility of the cushioning member in the midsole forefoot region when compared to a cushioning member without one or more channels 74. As schematically illustrated in FIG. 3, it is within the scope of the present disclosure that the channels, when present, may generally span an entire width of the central aperture of the lasting member, while in other embodiments, the channels may not span the entire width of the central aperture. It is also within the scope of the present disclosure that a channel 74, when present, may extend generally perpendicular to, or at a transverse angle that is not perpendicular to, the longitudinal axis of the midsole, as schematically and optionally illustrated in FIG. 3. In FIGS. 3-4, three spaced-apart channels are illustrated, but it is within the scope of the present disclosure that a greater or lesser number (including no channels) may be utilized and incorporated into a cushioning member 52.

Still referring to FIGS. 2-4 and as mentioned, midsoles 30 according to the present disclosure optionally may include a shank 54. When present, the shank is configured to increase the rigidity of at least a portion of the midsole and thus of sole assembly 14 of an article of footwear 10 according to the present disclosure. Accordingly, shanks 54 according to the present disclosure are typically stiffer, or more rigid, than lasting member 50 and cushioning member 52. Illustrative, non-exclusive examples of suitable materials for construction of shanks include (but are not limited to) metals and non-metals, such as synthetic, composite, plastic, and/or polymeric materials, including (but not limited to) one or more of carbon fiber composite, para-aramid fiber composite, polypropylene, and nylon, such as nylon 6.

Although not required in all embodiments, some shanks 54 according to the present disclosure may have a truss-stiffened construction, such as defined by a plurality of cavities, or removed regions, extending into the shank. Such a shank 54 additionally or alternatively may be described as including a plurality of interconnected reinforcing ribs or frames that provide strength and/or rigidity to the shank. This optional construction may be particularly suitable when the shank is constructed of a polymeric material to increase the rigidity and to decrease the weight of the shank when compared to a shank without such cavities. As an illustrative, non-exclusive example, the optional cavities may be irregular or regular in shape, such as being triangular, rectangular, pentagonal, hexagonal, or other polygonal shape. One or more of such examples of shanks may be described as having a honeycomb configuration or as having cavities in a honeycomb arrangement. Shank 54 may be formed by any suitable process, including one or more of a molding, milling, machining, and/or casting process. When formed from a non-metallic material, the shank may reduce the weight of the sole assembly and thus of the footwear 10 as a whole when compared to analogous footwear containing a metallic shank. A non-metallic shank also may provide the benefit of being rustproof.

As schematically illustrated in FIGS. 3-4, shank 54, when present, may be positioned generally within midsole arch region 58 and below at least a portion of cushioning member 52. In some embodiments, although not required, the shank is coupled to the underside of the cushioning member, and optionally may extend within the central aperture. However, it is also within the scope of the present disclosure that the shank be coupled to lasting member 50 and/or to outsole 26.

Typically, the shank will extend at least within midsole arch region 58, such as at least extending between midsole forefoot region 56 and midsole heel region 60. As illustrated in dash-dot lines in FIGS. 3-4, it is also within the scope of the present disclosure that in some embodiments, the shank may extend substantially into the midsole heel region.

As schematically represented in FIG. 3, the lateral edges of shanks 54 according to the present disclosure may in some embodiments generally conform to central aperture 64 of lasting member 50. Stated differently, the lateral edges of the shank may generally be aligned with, correspond to, and/or otherwise share a similar shape as a laterally adjacent portion of inner periphery 68 of the lasting member.

Additionally or alternatively, as also illustrated in dash-dot lines in FIG. 3, some embodiments of shanks 54 according to the present disclosure may include a forked forward portion 76 having two or more terminal regions 78 that are spaced apart from each other and that extend forward and toward, and in some embodiments into, midsole forefoot region 56. While FIG. 3 schematically and optionally illustrates two terminal regions 78, it is within the scope of the present disclosure that a shank 54 may include one, two, or more than two terminal regions extending toward the midsole forefoot region.

As best seen in the schematic representations of optional configurations of shanks 54 in FIG. 4, a shank according to the present disclosure may be positioned at least partially below, and in some embodiments substantially below or completely below, lasting member 50, at least with respect to a laterally adjacent portion of the lasting member. That is, depending on the overall shape and contour of a midsole, for example, while a rear portion of a shank may be below a laterally adjacent portion of the lasting member, the rear portion of the shank may not be below a forward portion of the lasting member. Additionally or alternatively, in some embodiments, the shank may be positioned within, partially within, at least partially within, or fully within central aperture 64 of the lasting member.

As mentioned, it is within the scope of the present disclosure that shank 54, when present, may extend into, and in some embodiments substantially into, midsole heel region 60. This is schematically illustrated in dash-dot lines in both of FIGS. 3 and 4. Moreover, with reference to FIG. 4, it is within the scope of such optional embodiments that the shank defines a heel strike projection 80 that extends below a forwardly adjacent portion of the shank, and which, in embodiments that include a heel 16, may be configured to engage the heel, at least when a user walks or runs along a ground surface while wearing footwear 10 having a shank with such a configuration. In some such embodiments, such a configuration is in contrast to and is mutually exclusive from the previously discussed optional embodiment of a midsole 30 in which cushioning member 52 defines a heel strike projection 72.

As discussed herein, midsoles 30 according to the present disclosure may include neither of or one of a heel strike projection 72 and a heel strike projection 80, as a component of, or characteristic of, cushioning member 52 and optional shank 54, respectively. It is also within the scope of the present disclosure, however, that a heel strike projection may be separately formed from the cushioning member and the shank, such as a component of lasting member 50, as a separate component coupled to one or more of the cushioning member, the lasting member, the optional shank, or other portion of sole assembly 14.

As mentioned with reference to FIG. 1, sole assemblies 30 according to the present disclosure may include one or more of a liner 32, an insole 34, and/or a footbed 36. It is within the scope of the present disclosure that midsole 30 may include the liner, such as (but not limited to) a woven or non-woven fabric, wicking, or other cover that forms the upper surface of the midsole, and which additionally or alternatively may extend above and cover the upper surface of cushioning member 52. Additionally or alternatively, such a liner, when present, may be described as a component of the cushioning member.

Figure 6:
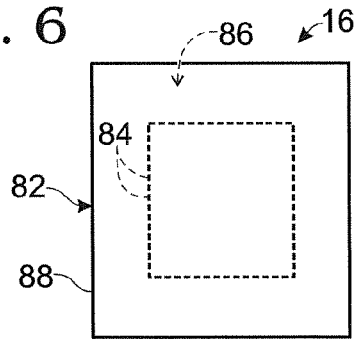
FIG. 6 is a schematic top view diagram representing heels according to the present disclosure.

Referring now to FIG. 6, a schematic top view of an optional heel 16 is presented. As mentioned, when present, a heel 16 will typically extend from and below the outsole heel region. As schematically illustrated in FIG. 6, the heel of an article of footwear 10 may (but is not required to) be constructed of one or more portions, such as including an outer barrier portion 82 and one or more inner portions 84, with the outer barrier portion generally defining an internal volume 86 within which the inner portion(s) are positioned. The internal volume may additionally or alternatively be described as a void, an internal space, a cavity, or a chamber 86.

As schematically illustrated in FIG. 6, the outer portion may include an outer surface 88, such as is generally accessible when an article of footwear 10 is fully assembled and that includes the previously discussed ground-contacting surface 42 (FIG. 1), and with the outer surface optionally defining a tread region. In some embodiments, the outer portion may be open on an upper side of the heel, so that when the heel is coupled to sole assembly 14, one or more of outsole 26 and midsole 30 may engage an inner portion 84. For example, depending on the configuration of a midsole incorporated into an article of footwear 10, one of a heel strike projection 72 (of cushioning member 52) and a heel strike projection 80 (of shank 54) may engage an inner portion 84, when present, at least when a user walks or runs along a ground surface while wearing footwear 10 having a cushioning member with such a configuration. That is, in some embodiments, a heel strike projection, when present, may generally be always in engagement with an inner portion of a heel, when the respective article of footwear is fully assembled, while in other embodiments, a heel strike projection may engage an inner portion of a heel only when a wearer's weight is applying a downward force in the heel region of the footwear or only when a wearer is actively walking, running, jumping, or otherwise causing a force greater than the weight of a typical wearer. As discussed herein, when a portion of the midsole engages the heel, such as an inner portion thereof, the outsole may include a heel aperture, through which a portion of the midsole, such as a heel strike projection, at least partially extends. Additionally or alternatively, it is within the scope of the present disclosure that an inner portion of the heel extends at least partially through a heel aperture of an outsole.

As mentioned, it is within the scope of the present disclosure that one or more inner portions 84 may be provided. Inner portion(s) 84, when present, may be constructed of any suitable material utilizing any suitable process, with the one or more materials being selected to provide a desired feel, springiness, comfort, performance, or other characteristic. Accordingly, in some embodiments, inner portion(s) 84 may be additionally or alternatively described as a shock-absorbing pad 84, with the pad being configured to absorb the forces imparted thereto when a wearer is actively using a respective article of footwear 10. Such a configuration may facilitate rebound and/or biasing of the midsole heel region, and thus a wearer's heel, away from a ground surface, as the wearer walks or otherwise actively uses the footwear. As illustrative, non-exclusive examples, one or more inner portions may be constructed of one or more of, including a blend of one of more of, ethylene-vinyl acetate, rubber, blown rubber, vinyl, or any other suitable resilient, elastomeric material or materials.

In some embodiments, two or more horizontal layers of inner portions 84 may be positioned within a heel 16, with such layers having different properties, such as (but not limited to) having different degrees of elasticity or resilience and thus different degrees of shock absorbing characteristics. As an illustrative, non-exclusive example, two layers may be provided with a lower layer having a stiffer, or less resilient, construction than an upper layer.

As mentioned, the one or more inner portions, or layers, of a heel may be constructed utilizing any suitable process. As an illustrative, non-exclusive example, inner portions in the form of pads may be die-cut. Alternatively, material defining the inner portion(s) may be injected into or otherwise formed inside of the internal cavity of the heel. Other configurations are also within the scope of the present disclosure.

Turning now to FIGS. 7-12, illustrative, non-exclusive examples of components of footwear 10 according to the present disclosure are illustrated. Where appropriate, the reference numerals from the schematic illustrations of FIGS. 1-6 are used to designate corresponding parts of footwear 10 according to the present disclosure; however, the examples of FIGS. 7-12 are non-exclusive and do not limit the present disclosure to the illustrated embodiments. That is, neither footwear 10 nor various portions thereof are limited to the specific embodiments disclosed and illustrated in FIGS. 7-12. Footwear 10 according to the present disclosure may incorporate any number of the various aspects, configurations, characteristics, properties, etc., such as which are illustrated in the embodiments of FIGS. 7-12, in the schematic representations of FIGS. 1-6, as well as variations thereof, without requiring the inclusion of all such aspects, configurations, characteristics, properties, etc. For the purpose of brevity, each previously discussed component, part, portion, aspect, region, etc. or variants thereof, may not be discussed again with respect to FIGS. 7-12; however, it is within the scope of the present disclosure that the previously discussed features, materials, variants, etc. may be utilized with the illustrated embodiments of FIGS. 7-12.

Figure 7:
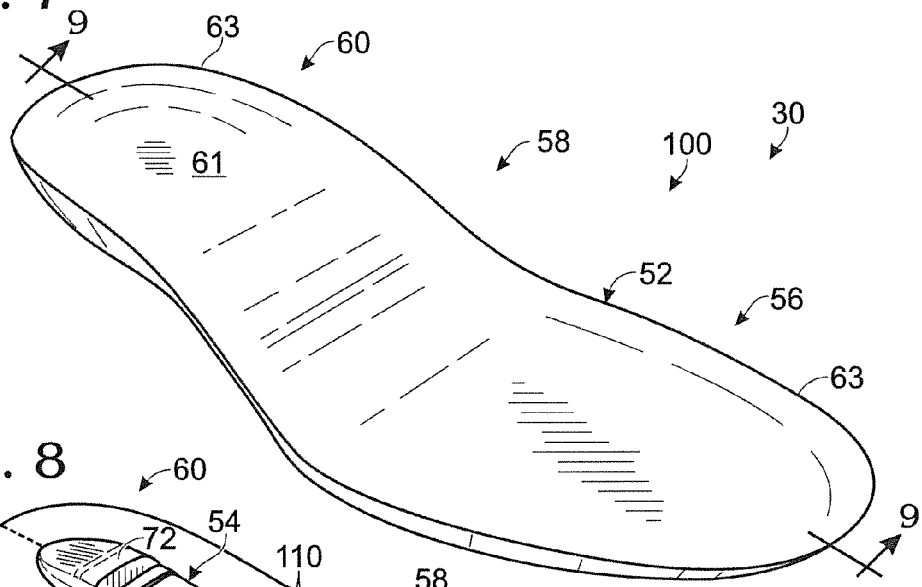
FIG. 7 is a perspective top view of an illustrative, non-exclusive example of a midsole according to the present disclosure.
Figure 8:
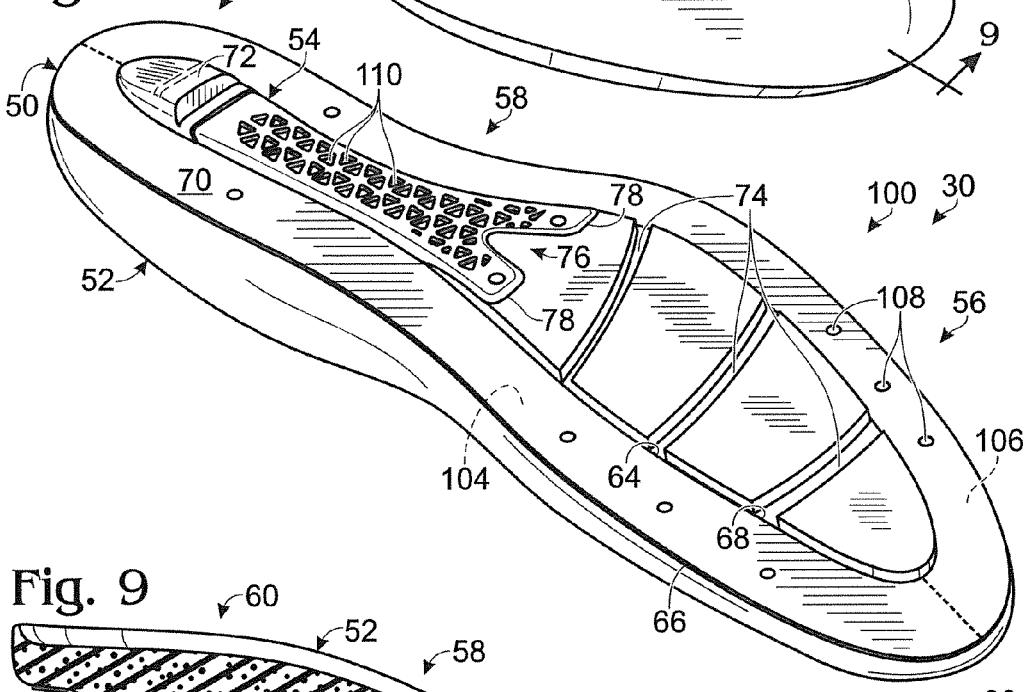
FIG. 8 is a perspective bottom view of the midsole of FIG. 7.
Figure 9:
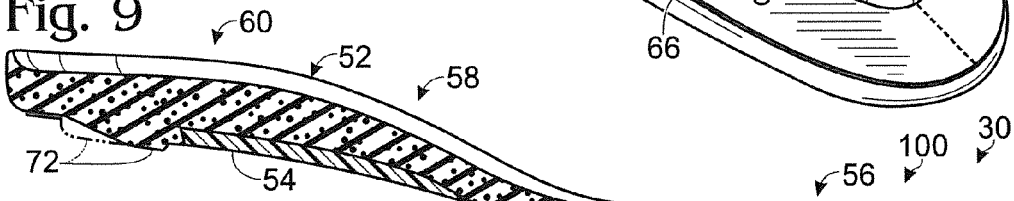
FIG. 9 is a side cross-sectional view of the midsole of FIG. 7, taken along line 9-9 in FIG. 7.

An illustrative, non-exclusive example of a midsole 30 according to the present disclosure is illustrated in FIGS. 7-9, with the illustrated midsole indicated generally at 100. Midsole 100 is an example of a midsole 30 with a cushioning member 52 molded to a lasting member 50, and including a shank 54. As best seen in FIGS. 7 and 9, the cushioning member of midsole 100 is an example of a cushioning member that extends across the entirety of the upper side of the midsole, across the midsole forefoot region 56, the midsole arch region 58, and the midsole heel region 60. Moreover, as best seen in FIG. 7, the cushioning member of midsole 100 defines a contoured foot cradle 61 with raised edge regions 63 along the periphery of the midsole arch region and the midsole heel region.

With reference to FIG. 8, the lasting member of midsole 100 is an example of a lasting member 50 having an outer periphery 66 and an inner periphery 68 that are concentric, such that the lasting member has a substantially constant width around the central aperture 64 of the lasting member. Lasting member 50 may be a unitary, or monolithic, structure; however, it is also within the scope of the present disclosure that lasting member 50 may be formed, or constructed, from two or more sections that collectively form the lasting member of the midsole. FIG. 8 provides an illustrative, non-exclusive example of such a construction, with the illustrated lasting member of midsole 100 optionally constructed in two sections, including a first section 104 and a second section 106, with the first and second sections generally coming together at the front and rear end regions of the midsole. While such a configuration is not required, it may be utilized to facilitate assembly of midsoles 100 according to the present disclosure.

As also seen in FIG. 8, the illustrated lasting member defines, or includes, a plurality of (optional) spaced-apart holes 108, with these optional holes being provided to facilitate securing the lasting member in place during (and/or may be produced as a result of) the assembly process, in which cushioning member 52 is molded, or otherwise adhered or coupled to, lasting member 50.

As mentioned, midsole 100 is an example of a midsole 30 that includes a shank 54. With continued reference to FIG. 8, the shank of midsole 100 is a truss-stiffened shank that includes a plurality of triangular cavities 110 and a forked forward portion 76 having two terminal regions 78 extending forward toward midsole forefoot region 56.

As illustrated in FIGS. 8-9, cushioning member 52 of midsole 100 extends fully through central aperture 64 of lasting member 50 in midsole forefoot region 56 and midsole heel region 60, with the portion extending through the forefoot region defining three transverse channels 74, and with the portion extending through the heel region extending a distance below the lasting member that is greater than a distance the portion extending through the forefoot region extends below the lasting member. The portion extending through the heel region defines a heel strike projection 72, which as discussed in more detail herein, may be configured to engage a heel of an article of footwear. In the illustrated example, the heel strike projection of the cushioning member has a generally rounded, or contoured, configuration, and tapers up toward the rear of midsole 100; however, such a configuration is not required, but when present, may facilitate proper positioning of the heel strike projection through a corresponding heel aperture of an outsole of an article of footwear 10 according to the present disclosure. As illustrated in dash-dot lines in FIG. 9, it is within the scope of the present disclosure that a heel strike projection of a midsole 30, including (but not limited to) a midsole 100, may have a more pronounced, or extensive, projection that does not significantly taper up toward the rear of the midsole. Other suitable variations of shapes, contours, extents of projections, etc. associated with heel strike projections are within the scope of the present disclosure.

As perhaps best understood with reference to FIG. 8 and FIG. 9 together, the portion of the cushioning member between the portions that extend fully through and below the central aperture of the lasting member extends fully through the central aperture but not below the central aperture. This portion, or region, of the cushioning member extends substantially in midsole arch region 58, and the shank 54 of midsole 100 is adhered directly to the underside of this portion of the cushioning member. Accordingly, the shank of midsole 100 is not positioned within the central aperture of the lasting member, at least when the midsole is in a non-compressed configuration, such as when an article of footwear 10 incorporating midsole 100 is not being worn by a wearer. In other words, while in FIG. 8 the shank of midsole 100 does not extend within the central aperture of the lasting member, it is within the scope of the present disclosure that the weight of a wearer of an article of footwear with a midsole 100 may cause one of the lasting member to lower around the shank and/or the shank to rise within the central aperture of the lasting member.

Figure 10:
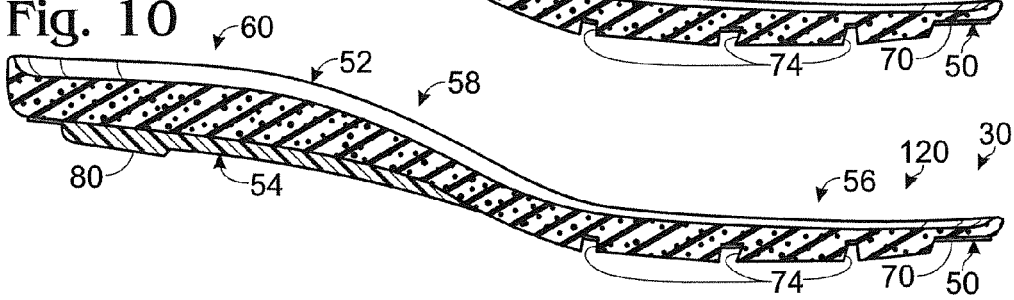
FIG. 10 is a side cross-sectional view of another illustrative, non-exclusive example of a midsole according to the present disclosure.

FIG. 10 illustrates in cross-section another illustrative, non-exclusive example of a midsole 30 according to the present disclosure, with the illustrated example indicated generally at 120. Midsole 120 is similar to midsole 100 of FIGS. 7-9; however, midsole 120 is an example of a midsole 100 with a shank 54 that extends into midsole heel region 60 and includes a heel strike projection 80. In the illustrated example, the heel strike projection of the shank of midsole 120 is shaped similarly to the optional heel strike illustrated in dash-dot lines in FIG. 9. However, it is also within the scope of the present disclosure that a midsole, including (but not limited to) a midsole 120 that includes a heel strike projection as a component of a shank, may include a tapered heel strike projection, such as similar to the heel strike projection illustrated in solid lines in FIGS. 8-9. Any suitable shape, contour, extent of projection, etc. associated with a heel strike projection, regardless of whether it is a component of the cushioning member or the shank, is within the scope of the present disclosure.

Figure 11:
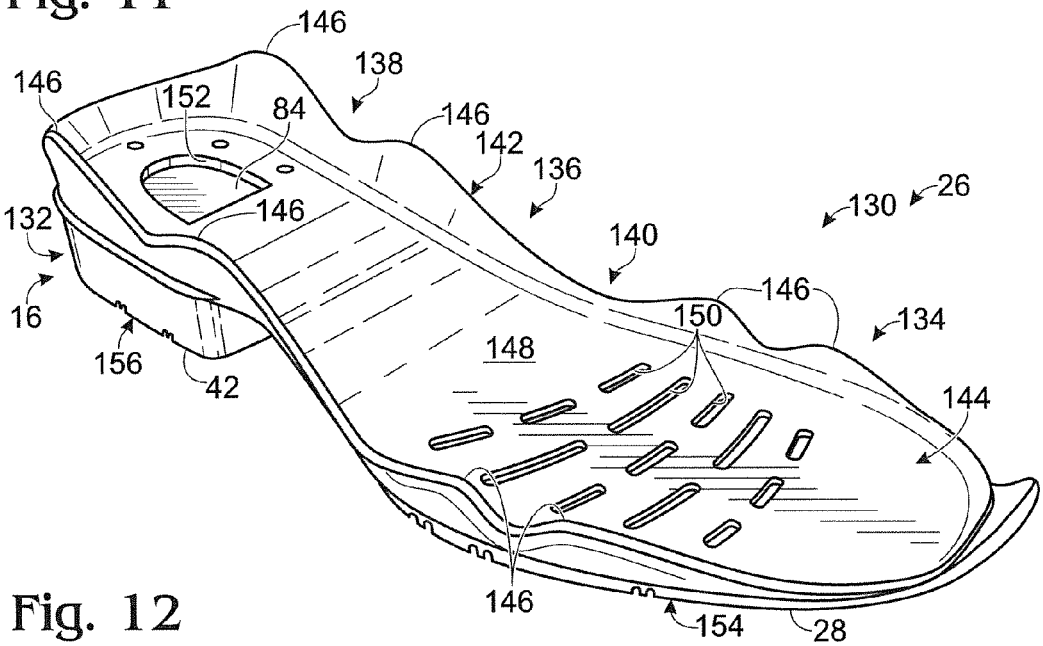
FIG. 11 is a perspective top view of an illustrative, non-exclusive example of an outsole and heel assembly according to the present disclosure.
Figure 12:
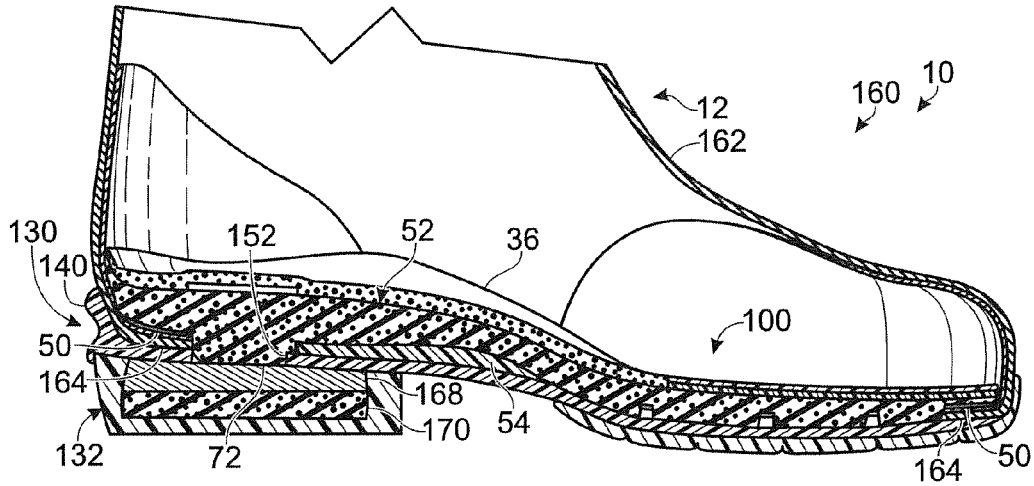
FIG. 12 is a side cross-sectional view of an illustrative, non-exclusive example of footwear according to the present disclosure, including the midsole of FIG. 7 and the outsole and heel assembly of FIG. 11.

FIG. 11 illustrates an illustrative, non-exclusive example of an outsole 26 together with an illustrative, non-exclusive example of a heel 16 according to the present disclosure, with the illustrated outsole and heel respectively indicated at 130 and 132. Outsole 130 may therefore be described as being configured for use with heeled footwear 10. Moreover, outsole 130 and heel 132 may be used with any suitable midsole 30 according to the present disclosure, including (but not limited to) midsole 100 and midsole 120 of FIGS. 7-9 and 10, respectively. FIG. 12, discussed in more detail herein, illustrates in cross-section an illustrative, non-exclusive example of a fully assembled article of footwear 10 according to the present disclosure, with the illustrated footwear including outsole 130, heel 132, and midsole 100.

Outsole 130 may be described as having an outsole forefoot region 134, an outsole arch (or midfoot) region 136, and an outsole heel region 138, and as including at least a shell 140 that is configured to be engaged with a midsole according to the present disclosure, such as a lower, or bottom, side of a midsole. That is, the shell is configured to receive the midsole during assembly of an article of footwear 10 according to the present disclosure, with the midsole being positioned directly above a substantial portion of the outsole. In some embodiments of outsoles 26 according to the present disclosure, such as outsole 130, the outsole may include an upwardly extending wall 142 around at least a substantial portion of an outer periphery of the shell and which generally defines a volume 144 of the shell, and which additionally or alternatively may be described as being cup-shaped or as having a cup-shaped configuration. It is within this volume that a midsole of an article of footwear 10 is at least partially received when an article of footwear is assembled. Shell 140 may additionally or alternatively be referred to as a body 140 or as a shell body 140 of outsole 130.

Although not required in all embodiments of outsoles according to the present disclosure, the upwardly extending wall 142 of the illustrated shell 140 may be described as including, or may be defined by, a plurality of lateral projections 146 that extend upwardly away from a lower surface 148 of the shell. In the illustrated example, the lateral projections are shown extending from the shell in the outsole forefoot region, the outsole arch region, and the outsole heel region; however, such a configuration is not required.

In the illustrated example, outsole 130 defines a plurality of slots 150 that extend through the shell within outsole forefoot region 134. In the illustrated example, the slots are generally transverse to the longitudinal axis of the outsole and are configured to increase the flexibility of shell 140, and in particular the forefoot region of the shell, when compared to an otherwise identical shell without the plurality of slots. The presence of optional slots 150 may additionally or alternatively reduce the overall weight of the shell, when compared to a shell without the plurality of slots. Shell 140 may be constructed of any suitable material, such as any suitable polymeric material, with thermopolyurethane being an illustrative, non-exclusive example.

The shell of outsole 130 defines a heel aperture 152 that extends through the shell within outsole heel region 138. Accordingly, when utilized with a midsole having a heel strike projection, such as a heel strike projection 72 or a heel strike projection 80, the projection will be permitted to extend through the heel aperture and, in some embodiments, into contact with a heel 16, as discussed herein. In the illustrated example of FIG. 11, heel 132 includes an inner portion 84 in the form of a shock-absorbing pad accessible through the heel aperture.

As seen in FIG. 11, outsole 130 includes a forefoot tread 154 coupled to an underside of shell 140, with the forefoot tread including forefoot ground-contacting surface 28, and heel 132 includes a heel tread 156 that includes heel ground-contacting surface 42.

Turning now to FIG. 12, an illustrative, non-exclusive example of a fully assembled article of footwear 10 is illustrated in cross-section and is indicated generally at 160. The illustrated footwear 160 includes midsole 100, outsole 130, and heel 132 according to the present disclosure. As seen, upper 12 of footwear 160 includes a body 162 that wraps around and extends at least partially underneath the midsole, with the body defining a peripheral flange 164 that, on its topside, is adhered to the underside of lasting member 50, and that, on its bottom side, is adhered to the inside of shell 140.

As seen in FIG. 12, shell 140 is engaged with and adhered to the lower side of midsole 100, at least within a substantial portion of the midsole forefoot region, the midsole arch region, and a substantial portion of the midsole heel region. The shell is not engaged with the entirety of the lower side of the midsole, because, as discussed, the upper extends at least partially between the midsole and the shell, including along the peripheral region of the midsole, in which the lasting member is positioned.

As mentioned, midsole 100 includes a heel strike projection 72 as a component of cushioning member 52, with the heel strike projection optionally extending through heel aperture 152 of shell 140 and for engagement with an upper shock-absorbing pad 168 of heel 132. In the illustrated example of FIG. 12, the heel strike projection includes a pronounced projection that fully extends through the heel aperture; however, as discussed herein, other suitable variations of shapes, contours, extents of projections, etc. associated with heel strike projections are within the scope of the present disclosure. The illustrated heel includes two inner portions including an upper shock-absorbing pad 168 and a lower shock-absorbing pad 170 positioned within the internal volume of the heel.

Footwear 160 is also illustrated as including an optional footbed 36, which in the illustrated embodiment is a removable footbed.

Figure 13:
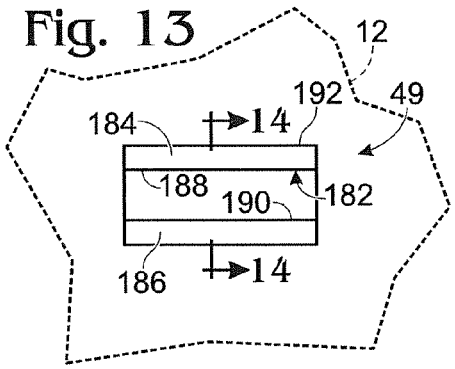
FIG. 13 is a schematic diagram representing spur support members according to the present disclosure, supported by a portion of an article of footwear.
Figure 14:
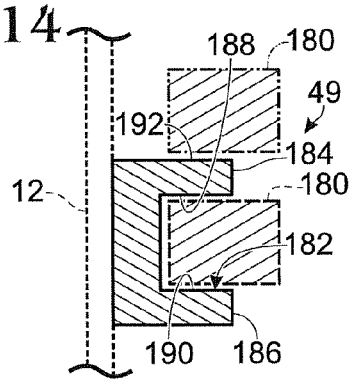
FIG. 14 is a schematic side cross-sectional view diagram representing spur support members according to the present disclosure, supported by a portion of an article of footwear, and illustrating optional positions of a spur in relation to a spur support member.

Turning now to FIGS. 13-14, optional spur support members 49 according to the present disclosure are schematically represented. Spur support members additionally or alternatively may be referred to as spur retainers or as spur cradles. In the schematic illustrations of FIGS. 13-14, spur support member 49 is illustrated as being coupled to, or otherwise supported by, an upper 12 of an article of footwear 10 according to the present disclosure. Additionally or alternatively, however, spur support members may be described as being a component of an upper or as being integral to an upper of footwear 10. Additionally or alternatively, spur support members may be supported by or may be a component of any other suitable portion of an article of footwear, such as (but not limited to) a heel and/or an outsole of an article of footwear. Moreover, it is within the scope of the present disclosure that a spur support member 49 may be releasably coupled to, or supported by, an article of footwear. In FIGS. 13-14, an upper 12 is illustrated schematically in dashed lines, representing that support by an upper is only an illustrative, non-exclusive example, and the present disclosure is not limited to spur support members being supported by, coupled to, or as a component of an upper.

In embodiments where a spur support member is coupled to, or is otherwise a component of, an upper, the spur support member may be supported by the upper in any suitable manner, including (but not limited to) being adhered to an outer surface of the upper, being adhered to an outer surface of an inner layer of the upper and extending through an outer layer of the upper, being adhered or otherwise coupled to a removable, or partially detachable, portion of the upper, etc. Other configurations are also within the scope of the present disclosure.

Spur support members 49 are configured to receive and retain a spur 180 in a selected position. Some spur support members according to the present disclosure are configured to support a spur in at least two distinct positions, so that a user may selectively position the spur in a desired position of the at least two distinct positions. As an illustrative, non-exclusive example, and with reference to FIGS. 13-14, spur support member 49 defines a channel 182 that is positioned and configured to receive and retain a spur in a selected position, and more specifically, within the channel. For example, typical spurs include a yoke, which additionally or alternatively may be referred to as a heel band or a body of the spur, that is sized and shaped to extend at least partially around a rear region of an article of footwear, such as a riding boot. The yoke, or body, of a spur is schematically illustrated in cross-section in dashed lines in FIG. 14, with the yoke positioned and received within channel 182 of spur support member 49.

In the schematically illustrated example, spur support member 49 includes an upper elongate projection 184 and a lower elongate projection 186, with the upper elongate projection defining an upper edge 188 of channel 182 and the lower elongate projection defining a lower edge 190 of the channel. The elongate projections additionally or alternatively may be referred to as projecting ribs or stops. The upper elongate projection includes an upper surface 192, upon which a spur 180 may be selectively positioned by a user, as schematically illustrated in FIG. 14 with the spur illustrated in this second, alternative position in dash-dot lines. Accordingly, spur support members 49 according to the present disclosure define two spur retaining positions including an upper position and a lower position. When the spur is in the upper position, the spur is engaged with upper surface 192, and when the spur is in the lower position, the spur is received in channel 182. Regardless of which position a spur is selectively positioned, further adjustment of the spur in a downward direction is restricted.

Any number of spur support members 49 may be incorporated into an article of footwear 10, and spur support members 49 may be positioned at any suitable location on an article of footwear 10. As illustrative, non-exclusive examples, a spur support member may be positioned on a rear of the footwear and/or on a lateral side of the footwear. In footwear that includes more than one spur support member, a left spur support member may be positioned on a left side of the footwear and a right spur support member may be positioned on a right side of the footwear.

Figure 15:
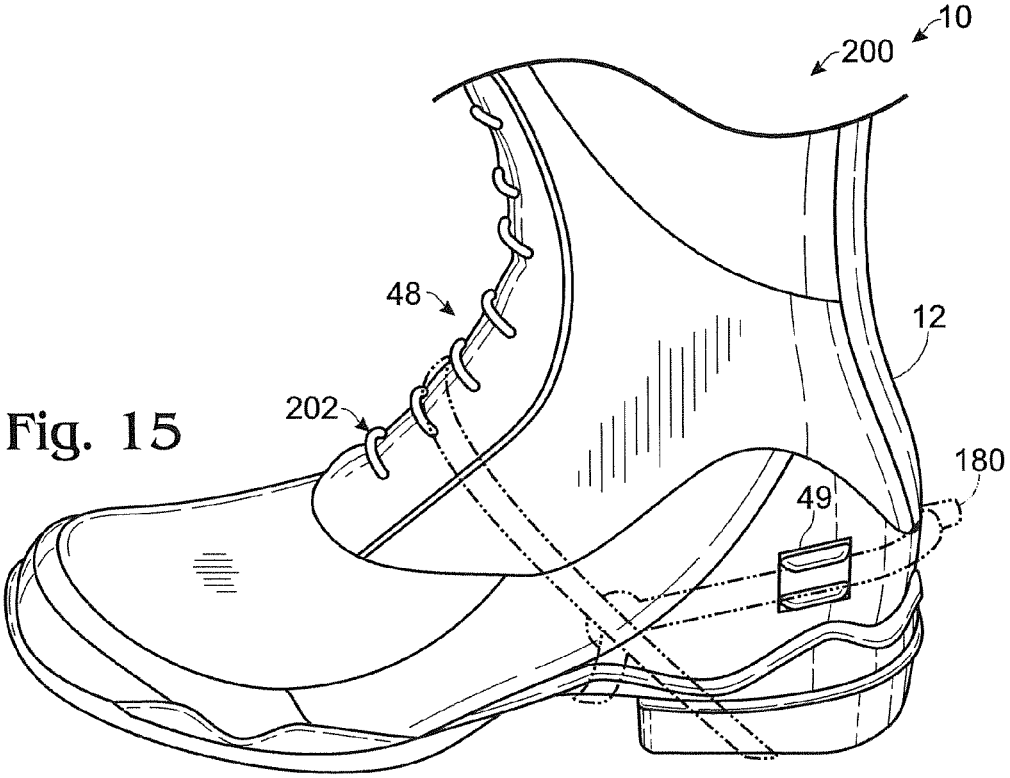
FIG. 15 is an isometric side view of an illustrative, non-exclusive example of a portion of a boot according to the present disclosure, including a spur support member.
Figure 16:
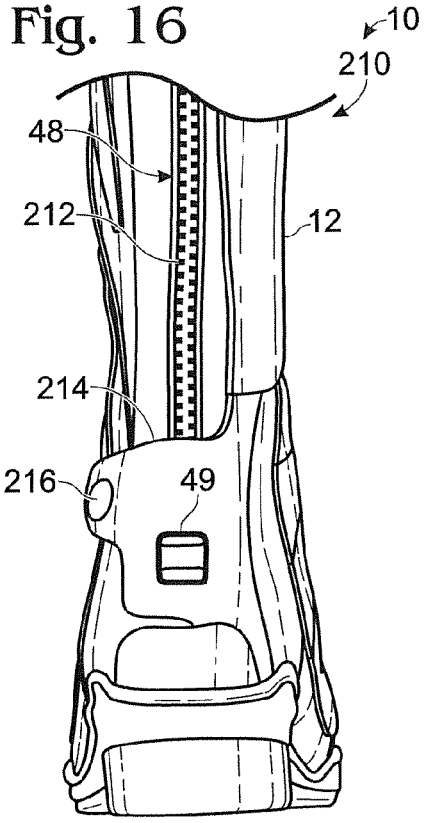
FIG. 16 is a rear view of another illustrative, non-exclusive example of a portion of a boot according to the present disclosure, including a spur support member.
Figure 17:
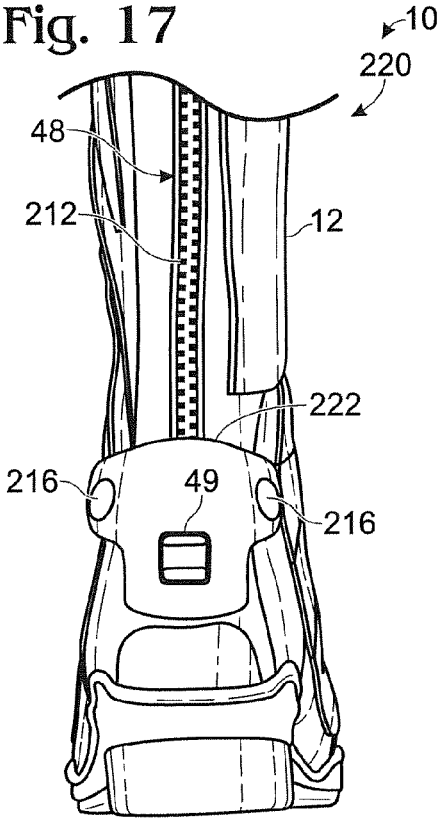
FIG. 17 is a rear view of another illustrative, non-exclusive example of a portion of a boot according to the present disclosure, including a spur support member.

Turning now to FIGS. 15-17, illustrative, non-exclusive examples of footwear 10 that include one or more spur support members 49 according to the present disclosure are illustrated. Where appropriate, the reference numerals from the schematic illustrations of FIGS. 13-14 as well as of FIGS. 1-6 are used to designate corresponding parts of footwear 10 according to the present disclosure; however, the examples of FIGS. 15-17 are non-exclusive and do not limit the present disclosure to the illustrated embodiments. That is, neither footwear 10 nor various portions thereof are limited to the specific embodiments disclosed and illustrated in FIGS. 15-17. Footwear 10 according to the present disclosure may incorporate any number of the various aspects, configurations, characteristics, properties, etc., such as which are illustrated in the embodiments of FIGS. 15-17, in the schematic representations of FIGS. 1-6 and 13-14, as well as variations thereof, without requiring the inclusion of all such aspects, configurations, characteristics, properties, etc. For the purpose of brevity, each previously discussed component, part, portion, aspect, region, etc. or variants thereof, may not be discussed again with respect to FIGS. 15-17; however, it is within the scope of the present disclosure that the previously discussed features, materials, variants, etc. may be utilized with the illustrated embodiments of FIGS. 15-17.

FIG. 15 illustrates an illustrative, non-exclusive example of footwear 10 in the form of an equestrian riding boot 200, with the illustrated boot including an optional releasable fastener 48 in the form of lacing structure 202 and a spur support member 49 supported on the left lateral side of the upper 12 of boot 200. Typically, a corresponding spur support member also may be supported on the right lateral side of the upper. An illustrative, non-exclusive example of a spur 180 is shown in FIG. 15, with the yoke of the spur received within the channel of the illustrated spur support member 49.

FIG. 16 illustrates another illustrative, non-exclusive example of footwear 10 in the form of another equestrian riding boot 210, with the illustrated boot including a releasable fastener 48 in the form of a rear zipper 212 extending vertically along the rear side of the boot. Boot 210 also includes a spur support member 49 that is supported by a base 214 that is constructed substantially of a flexible material, such as leather, and that defines a flap that is secured to the upper at a lateral region of the base. In the illustrated, non-exclusive example of boot 210, the base is secured to the upper on the right side of the base and extends behind and overlaps the rear zipper of the boot. The base and upper include snap structure 216, with the snap structure of the base being positioned on the left side of the base, generally opposite the lateral region in which the base is secured to the upper.

While a snap structure is illustrated in the example of FIG. 16, any suitable releasable fastening mechanism may be used.

With reference to FIG. 16, it can be seen that the base, or flap, 214 may be selectively fastened and unfastened to permit a user to access the full length of the zipper. When fastened, the spur support member is appropriately positioned on a rear side of the boot so that a user may selectively position a corresponding spur in one of the two optional spur positions, as discussed herein.

Another illustrative, non-exclusive example of an equestrian riding boot is illustrated in FIG. 17 and is indicated generally at 220, with boot 220 being similar to boot 210 of FIG. 16. However, with reference to FIG. 17, it can be seen that boot 220 includes a spur support member 49 supported by a base 222 that is constructed substantially of a flexible material, such as leather, and that is releasably coupled to and removable from the upper 12 of the boot. That is, in contrast to boot 210, which includes a flap 214 that is only partially releasable from the upper, base 222 is completely removable from the remainder of the boot. In the illustrated example, the base includes two snap structures 216 on opposite lateral regions of the base, with the upper including corresponding snap structure for selective mating with the base. Accordingly, when mated, as illustrated in FIG. 17, the base extends behind and overlaps the zipper and appropriately positions the spur support member on a rear side of the boot.

Additional components, constructions, configurations, materials, and the like that may be utilized in soles and/or footwear according to the present disclosure are disclosed in U.S. Pat. No. 6,497,057, U.S. Pat. No. 7,380,353, U.S. Pat. No. 7,752,733, and U.S. Patent Application Publication No. 2010/0126044, the complete disclosures of which are hereby incorporated by reference.

The following enumerated paragraphs represent illustrative, non-exclusive ways of describing inventions according to the present disclosure.

As used herein, "selective" and "selectively," when modifying an action, movement, configuration, or other activity of one or more components or characteristics of footwear according to the present disclosure, means that the specified action, movement, configuration, or other activity is a direct or indirect result of user manipulation of an aspect of, or one or more components of, the footwear.

As used herein the terms "adapted" and "configured" when used to describe an element, component, or other subject matter, mean that the element, component, or other subject matter is designed and/or intended to perform the recited function. Thus, the use of the terms "adapted" and "configured" should not be construed to mean that a given element, component, or other subject matter simply is "capable of" performing the recited function. Rather, the element, component, and/or other subject matter is created specifically for the purpose of performing the recited function. It is also within the scope of the present disclosure that elements, components, and/or other subject matter that is recited as being configured to perform a particular function may additionally or alternatively be described as being adapted to perform that function, and vice versa.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

In the event that any of the patent documents that are incorporated by reference herein defines a term in a manner or is otherwise inconsistent with either the non-incorporated disclosure of the present application or with any of the other incorporated references, the non-incorporated disclosure of the present application shall control and the term or terms as used therein only control with respect to the patent document in which the term is defined.

The disclosure set forth above encompasses multiple distinct inventions with independent utility. While each of these inventions has been disclosed in a preferred form or method, the specific alternatives, embodiments, and/or methods thereof as disclosed and illustrated herein are not to be considered in a limiting sense, as numerous variations are possible. The present disclosure includes all novel and non-obvious combinations and subcombinations of the various elements, features, functions, properties, methods and/or steps disclosed herein. Similarly, where any disclosure above or claim below recites "a" or "a first" element, step of a method, or the equivalent thereof, such disclosure or claim should be understood to include one or more such elements or steps, neither requiring nor excluding two or more such elements or steps.

Inventions embodied in various combinations and subcombinations of features, functions, elements, properties, steps and/or methods may be claimed through presentation of new claims in a related application. Such new claims, whether they are directed to a different invention or directed to the same invention, whether different, broader, narrower, or equal in scope to the original claims, are also regarded as included within the subject matter of the present disclosure.

INDUSTRIAL APPLICABILITY

The present disclosure is applicable to the footwear industry.

The invention claimed is:

1. Footwear, comprising:

an upper; and a sole assembly coupled to the upper and defining with the upper a foot compartment sized to receive a wearer's foot, wherein the sole assembly includes:

an outsole having an outsole forefoot region, an outsole arch region, and an outsole heel region, wherein the outsole forefoot region, the outsole arch region, and the outsole heel region are positioned generally underneath a forefoot region, an arch region, and a heel region, respectively, of the wearer's foot when the wearer's foot is received in the foot compartment, and wherein the outsole forefoot region includes at least a forefoot ground-contacting surface of the footwear; and a midsole positioned above at least a portion of the outsole and having a midsole forefoot region above the outsole forefoot region, a midsole arch region above the outsole arch region, and a midsole heel region above the outsole heel region, wherein the midsole includes:

a peripheral member defining a peripheral region extending at least substantially around a lower side of the midsole, wherein the peripheral member defines a central aperture extending through the peripheral member within the midsole forefoot region, the midsole arch region, and the midsole heel region; and a cushioning member positioned at least above the peripheral member and extending across the midsole forefoot region, the midsole arch region, and the midsole heel region;

wherein the sole assembly further includes a heel extending from and below the outsole heel region, wherein the heel includes a heel ground-contacting surface of the footwear; and wherein a first portion of the cushioning member extends fully through the central aperture within the midsole heel region and defines a heel strike projection that engages the heel;

wherein a second portion of the cushioning member extends fully through the central aperture within the midsole forefoot region;

and wherein the first portion of the cushioning member extends a first distance below the peripheral member that is greater than a second distance below the peripheral member that the second portion of the cushioning member extends.

2. The footwear of claim 1, wherein the peripheral member includes a lasting surface on an underside of the peripheral member, wherein the upper is coupled to the peripheral member and engaged with the lasting surface, and wherein the peripheral member is stiffer than the cushioning member.

3. The footwear of claim 1, wherein the peripheral member is constructed of resin impregnated paperboard.

4. The footwear of claim 1, wherein the peripheral member has an outer periphery and an inner periphery that defines the central aperture, and wherein the outer periphery and the inner periphery are generally concentric.

5. The footwear of claim 1, wherein the peripheral member defines less than 75% of the lower side of the midsole.

6. The footwear of claim 1, wherein the cushioning member is molded to the peripheral member.

7. The footwear of claim 1, wherein the cushioning member does not extend below the peripheral member within at least a substantial portion of the midsole arch region.

8. The footwear of claim 1, wherein the cushioning member defines one or more channels on an underside of the cushioning member within the midsole forefoot region, wherein the one or more channels are generally transverse to a longitudinal axis of the midsole.

9. The footwear of claim 1, wherein the midsole further includes a shank.

10. The footwear of claim 9, wherein the shank is positioned substantially within the midsole arch region and is coupled to an underside of the cushioning member.

11. The footwear of claim 9, wherein the shank is positioned at least partially below the peripheral member.

12. The footwear of claim 9, wherein the shank includes a truss-stiffened construction defined by a plurality of cavities extending into the shank.

13. The footwear of claim 1, further comprising at least one spur support member positioned and configured to receive and retain a spur in at least two distinct positions.

14. Footwear, comprising:

an upper; and a sole assembly coupled to the upper and defining with the upper a foot compartment sized to receive a wearer's foot, wherein the sole assembly includes:

an outsole having an outsole forefoot region, an outsole arch region, and an outsole heel region, wherein the outsole forefoot region, the outsole arch region, and the outsole heel region are positioned generally underneath a forefoot region, an arch region, and a heel region, respectively, of the wearer's foot when the wearer's foot is received in the foot compartment, and wherein the outsole forefoot region includes at least a forefoot ground-contacting surface of the footwear; and a midsole positioned above at least a portion of the outsole and having a midsole forefoot region above the outsole forefoot region, a midsole arch region above the outsole arch region, and a midsole heel region above the outsole heel region, wherein the midsole includes:

a peripheral member defining a peripheral region extending at least substantially around a lower side of the midsole, wherein the peripheral member defines a central aperture extending through the peripheral member within the midsole forefoot region, the midsole arch region, and the midsole heel region; and a cushioning member positioned at least above the peripheral member and extending across the midsole forefoot region, the midsole arch region, and the midsole heel region;

wherein the midsole further includes a shank, wherein lateral edges of the shank generally conform to the central aperture.

15. The footwear of claim 14, wherein the peripheral member includes a lasting surface on an underside of the peripheral member, wherein the upper is coupled to the peripheral member and engaged with the lasting surface, and wherein the peripheral member is stiffer than the cushioning member.

16. The footwear of claim 14, wherein the peripheral member is constructed of resin impregnated paperboard.

17. The footwear of claim 14, wherein the peripheral member has an outer periphery and an inner periphery that defines the central aperture, and wherein the outer periphery and the inner periphery are generally concentric.

18. The footwear of claim 14, wherein the peripheral member defines less than 75% of the lower side of the midsole.

19. The footwear of claim 14, wherein the cushioning member is molded to the peripheral member.

20. The footwear of claim 14, wherein a portion of the cushioning member extends within the central aperture.

21. The footwear of claim 20, wherein the cushioning member extends within the central aperture within the midsole forefoot region and within the midsole heel region.

22. The footwear of claim 14, wherein the sole assembly further includes a heel extending from and below the outsole heel region, wherein the heel includes a heel ground-contacting surface of the footwear; and wherein a portion of the cushioning member extends fully through the central aperture within the midsole heel region and defines a heel strike projection that engages the heel.

23. The footwear of claim 14, wherein the cushioning member defines one or more channels on an underside of the cushioning member within the midsole forefoot region, wherein the one or more channels are generally transverse to a longitudinal axis of the midsole.

24. The footwear of claim 14, wherein the shank is positioned substantially within the midsole arch region and is coupled to an underside of the cushioning member.

25. The footwear of claim 14, wherein the shank is positioned at least partially below the peripheral member.

26. The footwear of claim 14, wherein the shank includes a truss-stiffened construction defined by a plurality of cavities extending into the shank.

27. The footwear of claim 14, wherein the sole assembly further includes a heel extending from and below the outsole heel region, wherein the heel includes a heel ground-contacting surface of the footwear; wherein the outsole includes: a shell engaged with the midsole, wherein the shell defines a heel aperture extending through the shell within the outsole heel region; and a forefoot tread coupled to an underside of the shell within the outsole forefoot region and including the forefoot ground-contacting surface; and wherein a portion of the cushioning member extends fully through the central aperture within the midsole heel region and defines a heel strike projection that extends through the heel aperture and engages the heel.

28. The footwear of claim 14, further comprising at least one spur support member positioned and configured to receive and retain a spur in at least two distinct positions.

29. Footwear, comprising:

an upper; and a sole assembly coupled to the upper and defining with the upper a foot compartment sized to receive a wearer's foot, wherein the sole assembly includes:

an outsole having an outsole forefoot region, an outsole arch region, and an outsole heel region, wherein the outsole forefoot region, the outsole arch region, and the outsole heel region are positioned generally underneath a forefoot region, an arch region, and a heel region, respectively, of the wearer's foot when the wearer's foot is received in the foot compartment, and wherein the outsole forefoot region includes at least a forefoot ground-contacting surface of the footwear; and a midsole positioned above at least a portion of the outsole and having a midsole forefoot region above the outsole forefoot region, a midsole arch region above the outsole arch region, and a midsole heel region above the outsole heel region, wherein the midsole includes:

a peripheral member defining a peripheral region extending at least substantially around a lower side of the midsole, wherein the peripheral member defines a central aperture extending through the peripheral member within the midsole forefoot region, the midsole arch region, and the midsole heel region; and a cushioning member positioned at least above the peripheral member and extending across the midsole forefoot region, the midsole arch region, and the midsole heel region;

wherein the midsole further includes a shank;

wherein the sole assembly further includes a heel extending from and below the outsole heel region, wherein the heel includes a heel ground-contacting surface of the footwear; wherein the shank extends across the midsole arch region and the midsole heel region; and wherein the shank defines a heel strike projection that engages the heel.

30. The footwear of claim 29, wherein the peripheral member includes a lasting surface on an underside of the peripheral member, wherein the upper is coupled to the peripheral member and engaged with the lasting surface, and wherein the peripheral member is stiffer than the cushioning member.

31. The footwear of claim 29, wherein the cushioning member is molded to the peripheral member.

32. The footwear of claim 29, wherein a portion of the cushioning member extends within the central aperture.

33. The footwear of claim 29, wherein the cushioning member extends within the central aperture within the midsole forefoot region and within the midsole heel region, and further wherein the cushioning member does not extend below the peripheral member within at least a substantial portion of the midsole arch region.

34. The footwear of claim 29, wherein the shank is positioned substantially within the midsole arch region and is coupled to an underside of the cushioning member.

35. The footwear of claim 29, wherein the shank is positioned at least partially below the peripheral member.

36. The footwear of claim 29, wherein the shank includes a truss-stiffened construction defined by a plurality of cavities extending into the shank.

37. The footwear of claim 29, further comprising at least one spur support member positioned and configured to receive and retain a spur in at least two distinct positions.

38. Footwear, comprising:

an upper; and a sole assembly coupled to the upper defining with the upper a foot compartment sized to receive a wearer's foot, wherein the sole assembly includes:

an outsole having an outsole forefoot region, an outsole arch region, and an outsole heel region, wherein the outsole forefoot region, the outsole arch region, and the outsole heel region are positioned generally underneath a forefoot region, an arch region, and a heel region, respectively, of the wearer's foot when the wearer's foot is received in the foot compartment, and wherein the outsole forefoot region includes at least a forefoot ground-contacting surface of the footwear; and a midsole positioned above at least a portion of the outsole and having a midsole forefoot region above the outsole forefoot region, a midsole arch region above the outsole arch region, and a midsole heel region above the outsole heel region, wherein the midsole includes:

a peripheral member defining a peripheral region extending at least substantially around a lower side of the midsole, wherein the peripheral member defines a central aperture extending through the peripheral member within the midsole forefoot region, the midsole arch region, and the midsole heel region; and a cushioning member positioned at least above the peripheral member and extending across the midsole forefoot region, the midsole arch region, and the midsole heel region;

wherein the sole assembly further includes a heel extending from and below the outsole heel region, wherein the heel includes a heel ground-contacting surface of the footwear; wherein the outsole includes: a shell engaged with the midsole, wherein the shell defines a heel aperture extending through the shell within the outsole heel region; and a forefoot tread coupled to an underside of the shell within the outsole forefoot region and including the forefoot ground-contacting surface; and wherein a portion of the cushioning member extends fully through the central aperture within the midsole heel region and defines a heel strike projection that extends through the heel aperture and engages the heel;

wherein the heel includes a resilient, shock-absorbing pad accessible through the heel aperture, and wherein the heel strike projection engages the resilient, shock-absorbing pad.

39. The footwear of claim 38, wherein the peripheral member includes a lasting surface on an underside of the peripheral member, wherein the upper is coupled to the peripheral member and engaged with the lasting surface, and wherein the peripheral member is stiffer than the cushioning member.

40. The footwear of claim 38, wherein the cushioning member is molded to the peripheral member.

41. The footwear of claim 38, wherein the midsole further includes a shank.

42. The footwear of claim 41, wherein the shank is positioned substantially within the midsole arch region and is coupled to an underside of the cushioning member.

43. The footwear of claim 41, wherein the shank is positioned at least partially below the peripheral member.

44. The footwear of claim 41, wherein the shank includes a truss-stiffened construction defined by a plurality of cavities extending into the shank.

45. The footwear of claim 38, further comprising at least one spur support member positioned and configured to receive and retain a spur in at least two distinct positions.

* * * * *